US005715971A

United States Patent [19]

Morand

[11] Patent Number: 5,715,971

[45] Date of Patent: Feb. 10, 1998

[54] PAPER TOWEL DISPENSER

[75] Inventor: Michel Morand, Montreal, Canada

[73] Assignee: G.H. Wood + Wyant Inc., Quebec, Canada

[21] Appl. No.: 609,622

[22] Filed: Mar. 1, 1996

[30] Foreign Application Priority Data

Jun. 23, 1995 [GB] United Kingdom ..... 9512835

[51] Int. Cl.[6] ..... A47K 10/24

[52] U.S. Cl. ..... 221/45; 242/593

[58] Field of Search ..... 221/45, 46, 33, 221/63, 303; 242/593, 137.1, 570, 132

[56] References Cited

U.S. PATENT DOCUMENTS

| | | | |
|---|---|---|---|
| 4,905,868 | 3/1990 | Beane et al. | 221/44 |
| 5,141,171 | 8/1992 | Yang | 242/55.54 |
| 5,205,455 | 4/1993 | Moody | 225/106 |
| 5,211,308 | 5/1993 | Decker et al. | 221/63 |
| 5,215,211 | 6/1993 | Eberle | 221/1 |
| 5,246,137 | 9/1993 | Schutz et al. | 221/44 |
| 5,370,338 | 12/1994 | Lewis | 242/593 |

*Primary Examiner*—Kenneth Noland

*Attorney, Agent, or Firm*—Shlesinger Arkwright & Garvey LLP

[57] ABSTRACT

A paper towel dispenser of the type dispensing towelling spirally from the center of a coreless roll of towelling while the roll stands upright. The dispenser is a knockdown dispenser having a separate base, a first casing part, and a second casing part. The dispenser can be shipped with the parts disassembled to save space and assembled onsite by connecting the base to the first casing part and then pivotally connecting the second casing part to the base. The roll of towelling sits on the base and the casing parts form an enclosure about the roll. The dispenser has a dispensing nozzle in the base through which the paper towelling is dispensed. An access opening is provided in the wall of the nozzle to make it easier to thread the towelling through the nozzle when loading a new roll of towelling in the dispenser. A dispensing ring may be provided in the bottom of the nozzle through which the towelling is dispensed. The ring can be replaced if worn or if a different size of dispensing opening is needed in the nozzle.

20 Claims, 4 Drawing Sheets

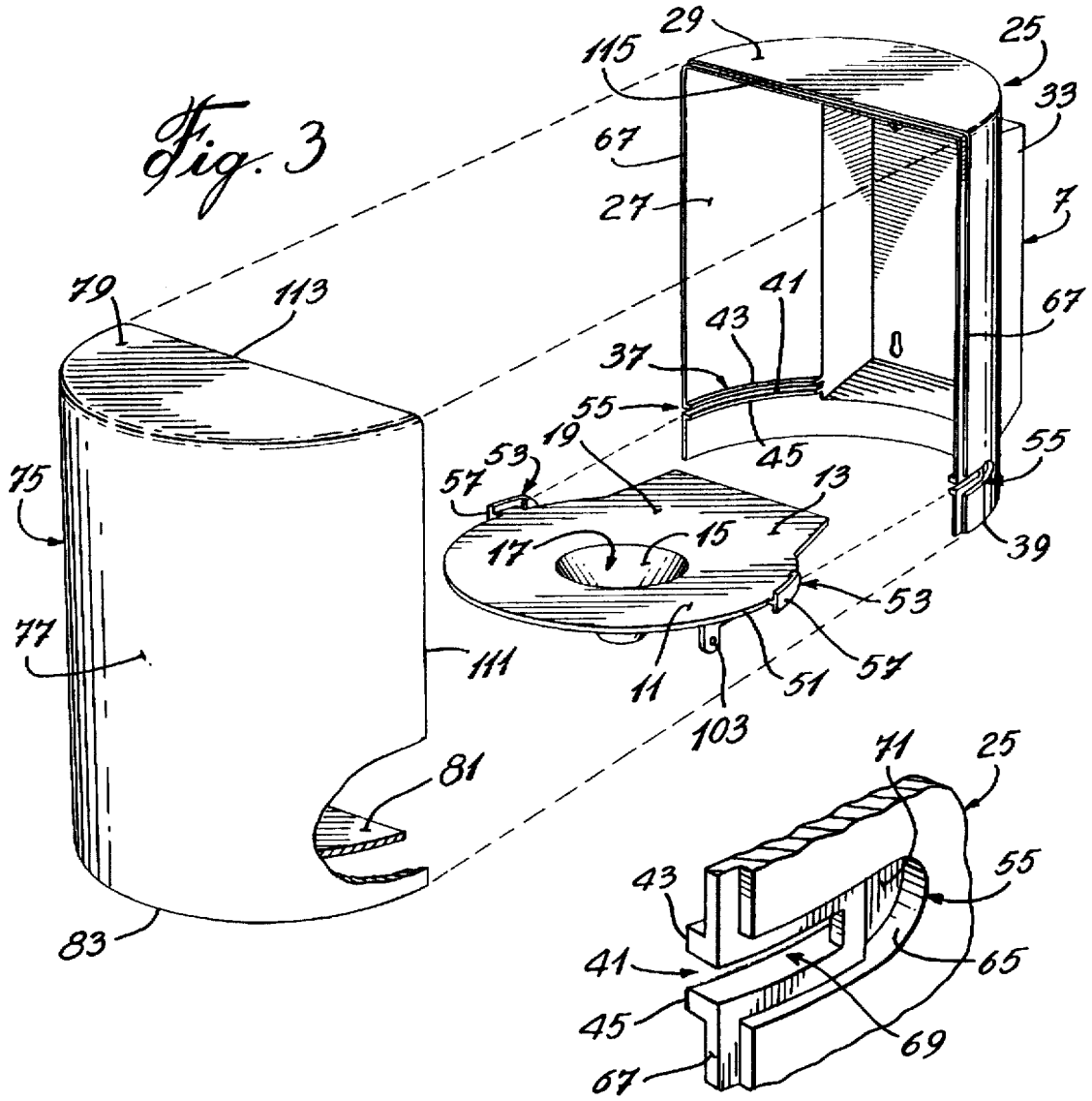
Fig. 3
Fig. 4B
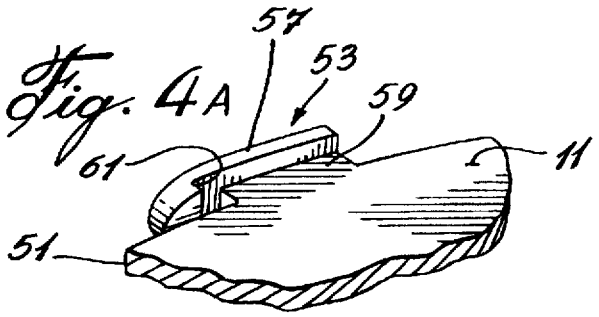
Fig. 4A

PAPER TOWEL DISPENSER

BACKGROUND OF THE INVENTION

1. Field of the Invention

This invention is directed toward an improved paper towel dispenser.

The invention is more particularly directed toward an improved paper towel dispenser of the type that dispenses towelling from the interior of a coreless roll of towelling.

2. Description of Related Art Including Information Disclosed Under 37 CFR ss 1.97 and 1.98

Dispensers for dispensing towelling from the interior of a coreless roll of towelling are known. The dispensers have a generally circular, horizontal base on which a roll of the towelling sits upright on one end and a one-piece cylindrical casing for enclosing the towelling on the base. The roll of towelling is of the type comprising a length of towelling, divided into joined-together sheets by spaced-apart, transverse lines of perforations. The length of towelling is rolled up to form the roll. The inner end of the towelling is pulled from within the roll and passed through a dispensing nozzle in the base. The nozzle has a tapered, through opening. The tapered opening frictionally restrains the towelling as it is pulled through the nozzle and the towelling tears off, one sheet at a time, along a line of perforations. U.S. Pat. Nos. 4,905,868 and 5,246,137 disclose dispensers of this type.

The known dispensers have several disadvantages. The dispenser takes up a lot of space when shipping or storing it since the casing is in one piece. Also, it is very difficult to thread the inner end of a new roll of towelling through the tapered opening in the nozzle. Usually two hands are needed and even then it is difficult particularly since dispensers of this type are usually placed higher than other dispensers. When two hands are used to thread the end of the towelling in place, the roll is unattended and may start unravelling. Further, the size of the tapered opening, while suitable for passing and tearing one type of towelling, may not be suitable for another type of towelling. Also, the size of the tapered opening can change due to wear, making the start of tearing difficult.

SUMMARY OF THE INVENTION

It is the purpose of the present invention to provide a dispenser that overcomes the above disadvantages of known dispensers. In accordance with the present invention, there is provided an improved dispenser that can be shipped or stored in a knock-down condition, the dispenser being easily assembled when needed. The dispenser is provided with a two part casing and a separate base. The dispenser can be shipped or stored with the two casing parts nested and with the base on top of the casings. Thus a package of about half the size that would be needed to store a dispenser having a single casing is all that is required. The dispenser can be easily assembled on site by fixedly mounting the base on the lower end of one casing part, and then pivotably mounting the other casing part on the base. The other casing pan is normally closed against the one casing part to form a complete casing but can be pivoted away from the one casing part to load a new roll of towelling on the base.

An improved dispenser is also provided having a construction making it easier to thread the towelling through the tapered opening in the nozzle when loading a new roll of towelling in the dispenser. The improved dispenser is provided with an access opening in the side wall of the nozzle. this access opening is normally closed during operation of the dispenser, but is opened When loading a new roll in the dispenser to make it possible to reach inside the nozzle to the tapered opening to more easily thread the towelling through it.

An improved dispenser is also provided with a replaceable dispensing ring mounted at the mouth of the opening in the .nozzle. A plurality of rings can be provided, each with a different sized outlet opening for the towelling. Thus an outlet opening can be provided to suit the particular towelling material being used. Alternatively, or at the same time, more than one ring of the same size can be provided so that a ring having a worn edge can be easily replaced without having to replace the nozzle or the base carrying nozzle.

The invention is particularly directed toward a paper towel dispenser of the type dispensing towelling spirally from the center of a coreless roll of towelling while the roll stands upright. The dispenser has a first casing part, a second casing part, and a base. The base has a dispensing nozzle for the towelling. The base is attached to the bottom of the first casing part. Cooperating pivot means on the second casing part and the base pivotably connect the second casing to the base. The second casing part is movable between a first, closed position where it forms, with the first casing part and the base, an enclosure for a roll of paper towelling that sits on one end on the base; and a second, open position where it is pivoted away from the first casing part allowing a new roll of towelling to be mounted on the base.

The invention is also particularly directed toward a paper towel dispenser of the type dispensing towelling spirally from the center of a coreless roll of towelling while the roll stands upright. The dispenser has a casing mounted on a base with the base having a dispensing nozzle in the approximate center thereof through which the towelling, standing on one end on the base, is dispensed. The nozzle has a through, tapered opening. There is an access opening in the wall of the nozzle providing access to the interior of the tapered opening to make it easier to thread the towelling through the tapered opening. Means are provided for normally closing the access opening during use of the dispenser.

The invention is also further particularly directed toward a paper towel dispenser of the type dispensing towelling spirally from the center of a coreless roll of towelling while the roll stands upright. The dispenser has a casing mounted on a base with the base having a dispensing nozzle in the approximate center thereof through which the towelling, standing on one end of the base, is dispensed. The nozzle has a through, tapered opening. Mounting means are provided at the mouth of the opening in the nozzle for mounting a dispensing ring therein through which the paper towelling is dispensed. The dispensing ring can be changed when worn or when a different size is needed.

BRIEF DESCRIPTION OF THE DRAWINGS

FIG. 3 is an exploded view of the dispenser;

FIG. 4A is a detail view of the tab;

FIG. 4B is a detail view of the cutout;

DESCRIPTION OF THE PREFERRED EMBODIMENTS

Figure 1:
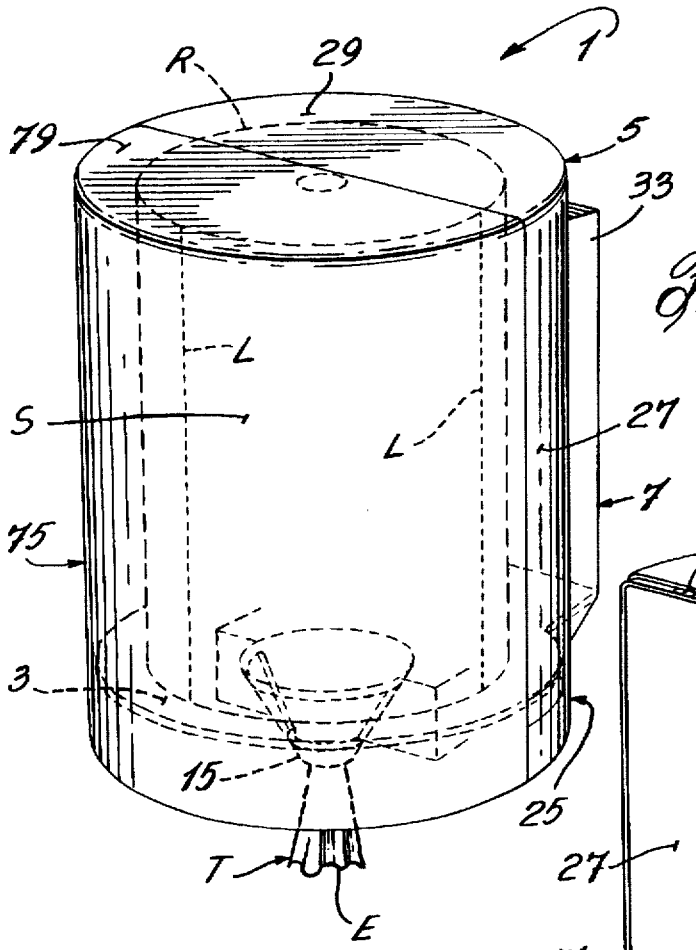
FIG. 1 is a perspective view of the dispenser in a closed position.
Figure 2:
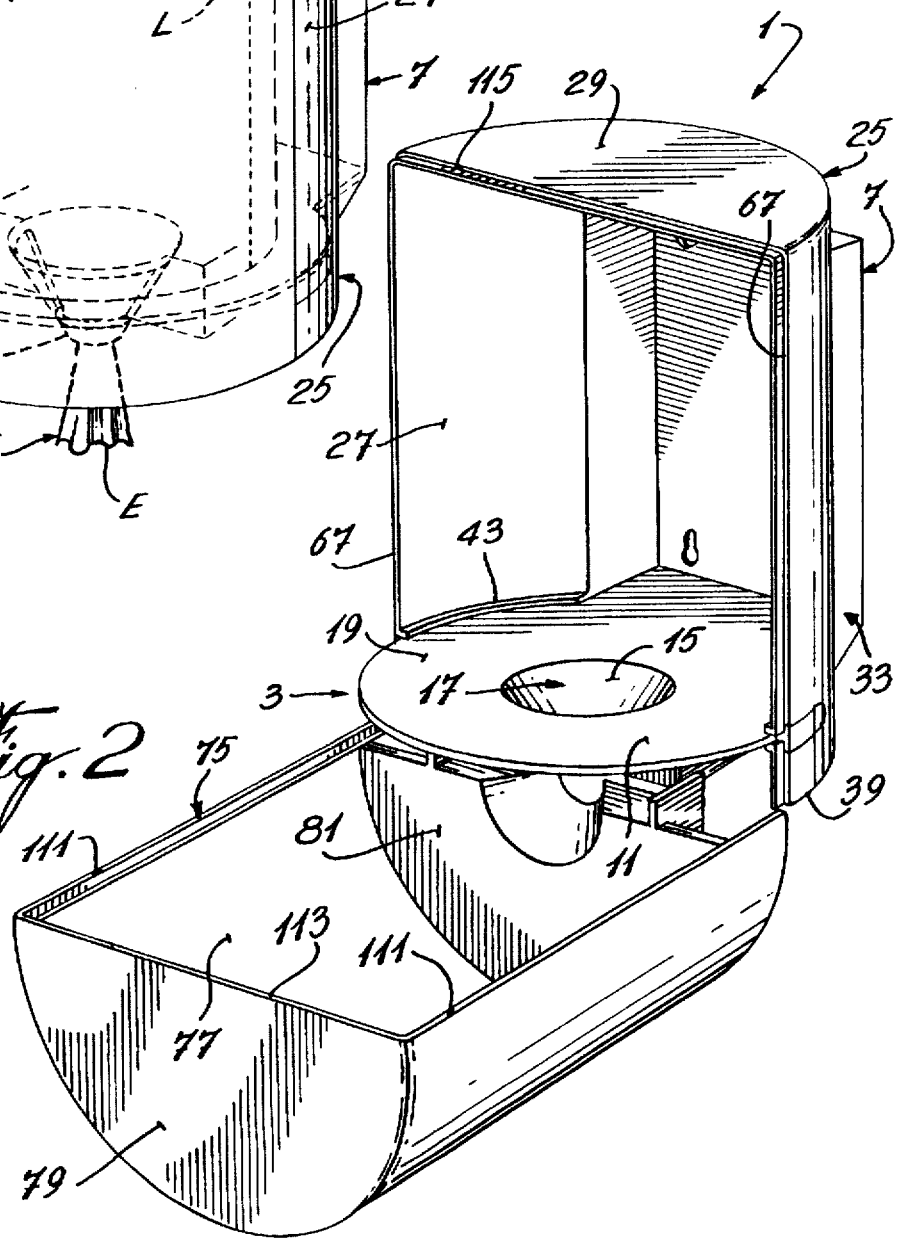
FIG. 2 is a perspective view of the dispenser in an open position.

The paper towel dispenser 1 of the present invention, as shown in FIGS. 1, 2 and 3, has a base 3 to support a roll R of paper towelling T thereon. The towelling is of the type having spaced-apart lines L of perforations extending transversely across the towelling to divide it into joined-together sheets S. In dispensing the towelling, one sheet at a time is tom off the towelling along a line L of perforations. Casing means 5 enclose the roll R of towelling while it sits on one end on the base 3, which is mounted on the casing means 5. Casing means 5 includes mounting means 7 for use in mounting the dispenser on a support such as a wall.

The base 3 has a horizontal, flat support 11 that is preferably generally circular in shape. A short angular extension 13, extending rearwardly, forms part of the support 11. The support 11 has a conical dispensing nozzle 15 extending downwardly therefrom in its approximate center. A tapered opening 17 extends through the nozzle 15 from the upper surface 19 of the support 11 to the bottom of the nozzle 15.

The casing means 5 has a rear casing 25 that is adapted to receive the rear half of the base 3. The rear casing 25 preferably has a semi-cylindrical side wall 27 and a semi-circular top wall 29. The side wall 27 has a rearwardly directed bulge 33 that ends in a flat, vertical wall forming part of the mounting means 7 for the dispenser. Base mounting means 37 are provided on the rear casing 25 on the interior of its side wall 27 and near its bottom edge 39 as shown in FIG. 3. The base mounting means 37 can comprise a circumferential extending channel 41 formed between two parallel ribs 43, 45 that extend about the interior of the side wall 27. The ribs 43, 45 defining the channel 41 are parallel to the bottom edge 39 of the casing 25.

The base 3 is mounted on the rear casing 25 by inserting the rear portion of the peripheral edge or rim 51 of the support 11 of the base 3 within the channel 41. The support 11 fits in the channel 41 with a tight friction fit with the rear extension 13 fitting within the mounting bulge 33.

Suitable cooperating locking means 53, 55 can be provided on the base 3 and the rear casing 25 for locking the base 3 and the rear casing 25 together in the assembled condition. The locking means 53 on the base 3 can comprise a pair of diametrically opposed, flexible tabs 57 on the rim 51 of the support 11. As shown in FIGS. 3 and 4A, the tabs 57 extend transversely to the support 11 and are attached to the support 11 by a web 59. The tabs 57 are spaced slightly outwardly from the rim 51 of the support 11 by the web 59 and follow its curvature. There is a small, inwardly directed locking projection 61 at the rear of each tab 57 extending past the web 59. The locking means 55 on the rear casing 25, as shown in FIGS. 3 and 4B, includes a cutout 65 on the outer surface of the rear casing 25 extending rearwardly from each front edge 67 of the casing and aligned with the channel 41. A slot 69 extends rearwardly from the front edge 67 of the casing joining the cutout 65 and the channel 41 together. There is a small depression 71 at the inner end of the cutout 65. When the base 3 and the rear casing 25 are assembled, the tabs 57 slide into the cutouts 65 with the webs 59 sliding through the slots 69. The locking projections 61 on the tabs 57 snap into the depressions 71 in the cutouts 65 to lock the base 3 and the rear casing 25 together. The tabs 57 fit flush in the cutouts 65 when the two pieces are assembled.

The casing means 5 includes a front casing 75. The from casing 75 preferably has a semi-cylindrical side wall 77 and a semi-circular top wall 79 as shown in FIGS. 1 to 3. The front casing 75 also has a semi-circular bottom wall 81 attached to the side wall 77 and spaced above the bottom edge 83 of the side wall.

Figure 5:
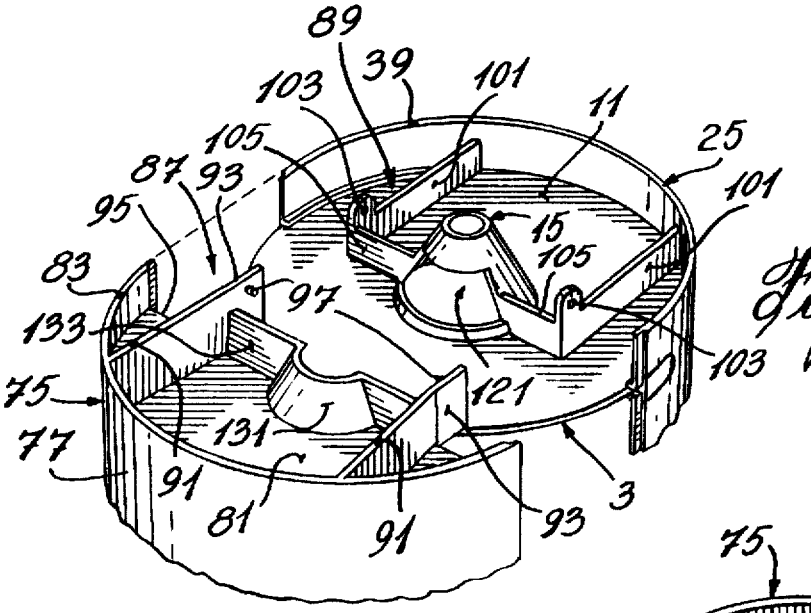
FIG. 5 is a detail bottom view of the dispenser before the front casing is connected to the base.
Figure 6:
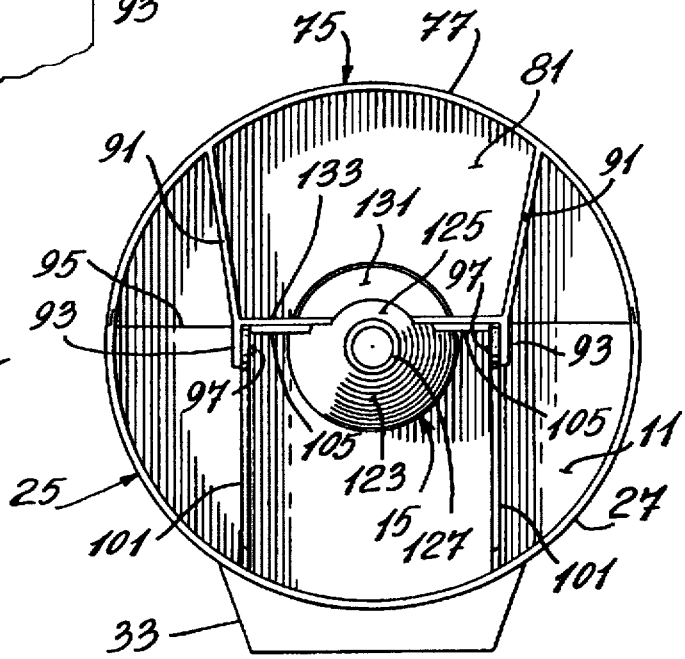
FIG. 6 is a bottom view of the assembled dispenser.

Cooperating pivot means 87, 89 are provided on the front casing 75 and the base 3 for pivotably connecting them together. The front casing 75, as shown in FIGS. 5 and 6, has two front webs 91 extending rearwardly from the front of the side wall 77 and under the bottom wall 81. The front webs 91 are transverse to the bottom wall 81 and have hinge portions 93 that extend just past the inner edge 95 of the bottom wall 81. The front webs 91 are integral with the bottom wall 81 and the side wall 77 and strengthen the structure. The front webs 91 converge slightly toward the inner edge 95 of the bottom wall 81 but the hinge portions 93 are parallel. The pivot means 87 on the front casing 75 comprise an inwardly directed hinge pin 97 carried at the lower end of each front web 91. The base 3 includes a pair of parallel rear webs 101 on the bottom of the platform 11 of the base which webs are transverse to the platform. The rear webs 101 are located on either side of the nozzle 15 and extend rearwardly from a point close to the front of the nozzle 15 onto the extension 13. The pivot means on the base 3 comprise pivot openings 103 in the bottom, front corners of the rear webs 101. Preferably, cross-webs 105 extend transverse to the rear webs 101 between the ends of the rear webs 101, adjacent the pivot openings 103 and the nozzle 15. The cross-webs 105 are aligned and strengthen the structure along with the rear webs 101.

The front casing 75 is mounted on the base 3 with the pivot means 87, 89. The pivot pins 97 on the hinge portions 93 of the front webs 91 of the front casing 75 are snapped into the pivot openings 103 on the rear webs 101 on the base 3 as shown in FIG. 6. The hinge portions are flexible enough to permit the pins 97 to be spread apart when mounting the front casing 75 on the base 3.

Once the from casing 75 is pivotably mounted onto the base 3, it can be pivoted to a first closed position, as shown in FIG. 1, to have the rear edges 111 of its side wall 77 abut the front edges 67 of the side wall 27 of the rear casing 25. At the same time, the rear edge 113 of its top wall 79 abuts the front edge 115 of the top wall 29 on the rear casing 25. The front portion of the support 11 rests within the front casing 75 just above the bottom wall 81. In this first closed position, the two casings 25, 75 form a cylindrical enclosure for a roll R of towelling sitting on the base 3. Suitable locking means, not shown, can be provided on the top walls 29, 79 of the casings 25, 75 for locking the casings together in the first closed position.

To load a roll of towelling in the dispenser, the front casing 75 is pivoted away from the rear casing 25 to a second, open position beneath the base 3 as shown in FIG. 2. In this position, the roll R of towelling is placed in an upright position on the base 3. Before placing the roll R on the base, the inner end E of the towelling is withdrawn from within the center of the roll and threaded through the opening 17 in the nozzle 15. Once the inner end of the towelling is threaded all the way through the opening 17 and the roll R is on the base 3, the front casing 75 is pivoted to the first closed position to form, with the rear casing 25, the enclosure about the roll R.

Figure 7:
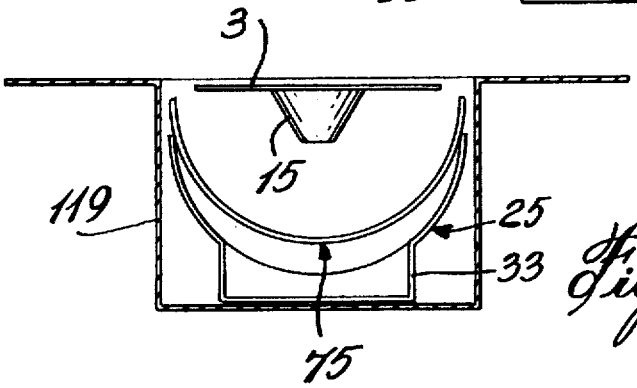
FIG. 7 is a cross-section view of the packaged dispenser.

The above dispenser 1 is easily shipped in a knockdown condition with the three parts 3, 25 and 75 all separate. The two casings 25, 75 are nested to conserve space and the base 3 sits on top of the casings across their front edges, as shown in FIG. 7, with the nozzle 15 within the top casing 75. The parts can be packaged in a package 119 which is only slightly greater than half the size of a package which would be needed for a dispenser having a one piece casing. Thus, less space is required for storage and for shipping. At the point of use, the dispenser 1 is easily assembled by mounting the base 3 in the channel 41 in the rear casing 25 and locking it in place with the locking means 53, 55 and then pivotably mounting the front casing 75 onto the base 3 with the pivot means 87, 89.

Figure 8:
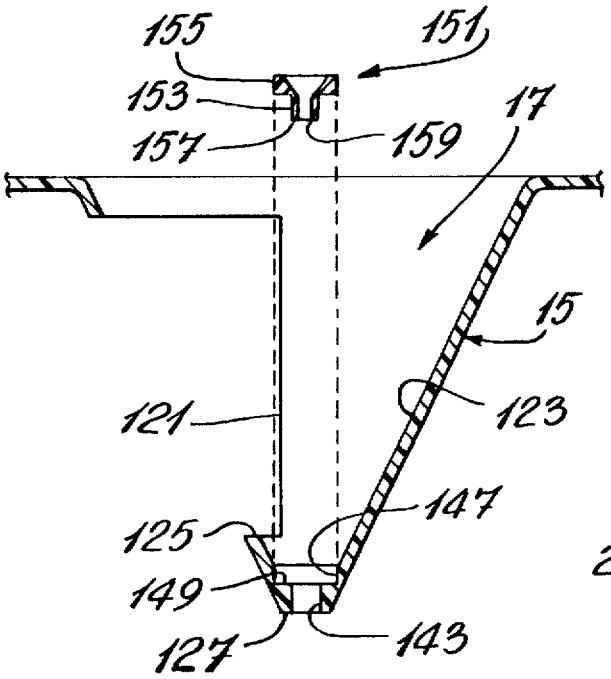
FIG. 8 is a cross-section view of the dispensing nozzle and a dispensing ring.
Figure 8A:
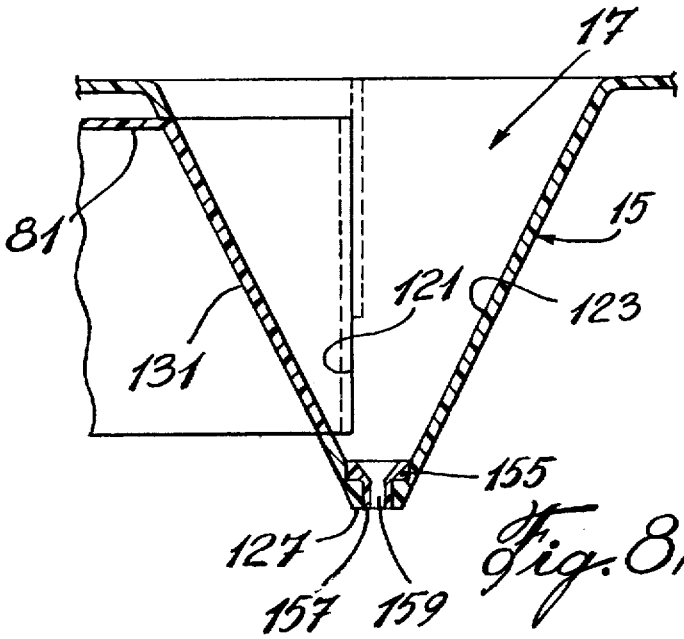
FIG. 8A is a cross-section view of the dispensing nozzle with the access opening closed.

In a preferred embodiment of the invention, the nozzle 15 is provided with an access opening 121 in its side wall 123 as shown in FIGS. 5, 8 and 8A. A portion of the side wall 123 is cut away to provide the opening 121 which is preferably located in the front portion of the nozzle 15. The access opening 121 preferably extends about one-third of the way around the circumference of the nozzle and does not extend over its full height, leaving instead a small ring portion 125 at the small bottom end 127 of the nozzle 15. The access opening 121 is used to help in threading the end of the towelling through the opening 17. The user's fingers can fit right inside the tapered opening through the access opening to thread the towelling through the tapered opening including the ring portion 125. Suitable means are provided for closing the access opening 121 when the dispenser is in use. In accordance with the present invention, the means provided for closing the access opening 121 comprises a wall section 13 1 that snugly fits into the opening 121. This is illustrated in FIG. 8A.The wall section 131 is preferably formed in a front cross-web 133 on the front casing 75 that extends between the front webs 91 adjacent to the back edge 95 of the bottom wall 81. In the closed position of the casings 25, 75, the front cross-web 133 lies adjacent to the rear cross-webs 105, as shown in FIG. 6, and the formed wall section 131 in the front cross-web 133 fits snugly within the access opening 121 forming a substantially complete, conical side wall 123 for the nozzle 15. Closing the access opening 121 with the wall section 131 provides for smooth flow of the towelling out of the dispenser, there being no edges for it to snag on.

While the access opening 121 in the nozzle 15 has been described for use with a knockdown dispenser, it could also be used with a regular dispenser of the type having a one part casing that is lifted off the base to load the roll R on the base. In this case, the wall section closing the access opening during dispenser use would be a separate piece with suitable means for positioning and holding it on the nozzle to close the opening. The wall section would be removed when loading a fresh roll in the dispenser so that the free end of the towelling could be more easily threaded through the nozzle.

The dispenser 1 can also be provided with a seat in the nozzle for receiving a dispensing ring. As more clearly shown in FIG. 8, the bottom of the tapered opening 17 in the nozzle 15 can be cylindrically bored slightly oversize as shown by the bore 143. The bore 143 is then counter-bored part way down from the top as shown by counter bore 147 to form a seat 149 close to the bottom end 127 of the nozzle 15. A dispensing ring 151, having a small cylindrical end 153 projecting axially from a larger cylindrical base 155 is mounted in the counter bore 147. The base 155 fits snugly in the counter bore 147 seated on the seat 149 while the smaller projecting end 153 fits snugly in the smaller bore 143 with its end face 157 flush with the bottom end 127 of the nozzle 15. The ring 151 has a central dispensing bore 159. The ring 151 is mounted in the nozzle 15 and the towelling is passed through it. The towelling E is pulled from the dispenser through the dispensing bore 159. The bore 159 creates a restriction and sufficient friction to cause the towelling to tear along perforations L. Paper is of course abrasive and use of the dispenser results in wear of the bore 159 increasing its diameter to the point that the friction created may not be sufficient to cause tearing of the towelling. When this happens the ring 151 can be easily replaced with another ring having the correct diameter. Alternatively, various rings can be provided, each with a different diameter dispensing bore 159. The appropriate ring can be selected for the particular type of towelling being used. Some towelling would require a larger bore 159 to provide the proper amount of friction to initiate tearing of the towel while other towelling would require a smaller bore.

The dispensing ring is preferably used in a knockdown dispenser of the type described above. However, the ring could be used with any type of dispenser which dispenses towelling from the interior of an upright roll of towelling. Also, the ring could be used with a dispenser that does not employ an access opening in the dispensing nozzle as described above.

The front casing can be made of a transparent material to assist in determining if the roll of towelling needs replacing.

Figure 9:
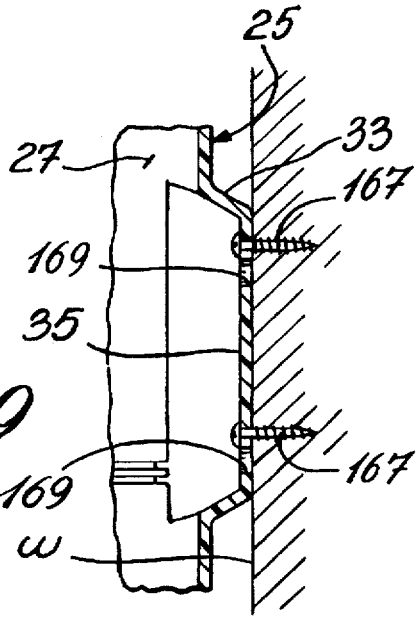
FIG. 9 is a detail view of the dispenser mounting.
Figure 10:
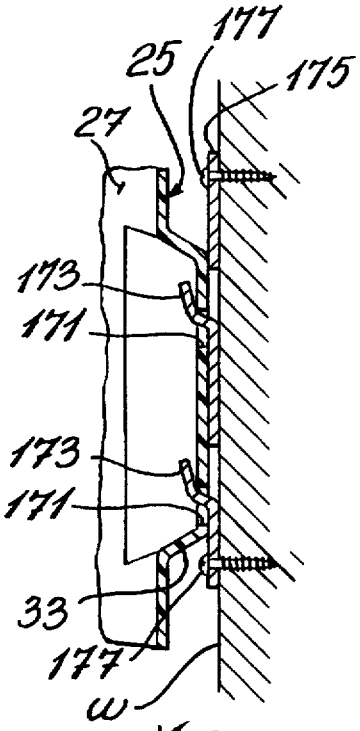
FIG. 10 is a detail view of the dispenser mounting using a mounting plate.

The dispenser 1 is easily mounted against a wall W by fasteners 167 passed through openings 169 in the back wall 35 of the bulge 31 in the rear casing 25 as shown in FIG. 9. Alternatively slots 171 can be provided in the back wall for receiving upwardly extending tongues 173 on a mounting plate 175 which in turn is mounted on the wall W with fasteners 177 as shown in FIG. 10.

I claim:

1. A paper towel dispenser of the type dispensing toweling spirally from the center of a coreless roll of toweling while the roll stands upright, the dispenser having a first casing part, a second casing part and a base; the base having a dispensing nozzle for the toweling; the base attached to the bottom of the first casing part; cooperating pivot means on the second casing part and the base for pivotably connecting the second casing part to the base; the second casing part movable between a first closed position where it forms with the first casing part and the base, an enclosure for roll of paper toweling that sits on one end on the base; and a second open position where it is pivoted away from the first casing part allowing a new roll of toweling to be mounted on the base; and an access opening in the wall of the nozzle, the access opening being normally closed when the second casing part is in the first closed position and being normally open when the second casing part is in the second open position to provide access to the interior of the nozzle to make it easier to thread the toweling through the nozzle when a new roll of toweling is mounted in the dispenser.

2. A paper towel dispenser as claimed in claim 1 wherein the access opening is closed by a wall portion that fits snugly within the opening, the wall portion carried by the second casing part in a position to fit snugly within the access opening when the second casing part is in the first closed position.

3. A paper towel dispenser as claimed in claim 1 including mounting means for mounting the base onto the first casing means and locking means for locking the base in position on the first casing means.

4. A paper towel dispenser as claimed in claim 3 wherein the mounting means comprises a channel formed on the inner surface of the side wall of the first casing part adjacent its bottom edge, the base having a thin support, a portion of the edge of which fits snugly within the channel.

5. A paper towel dispenser as claimed in claim 4 wherein the locking means comprises flexible tabs on the edge of the support, and cutouts on the outer surface of the first casing part, the tabs fitting in the cutouts to lock the base to the first casing part.

6. A paper towel dispenser as claimed in claim 1 wherein the base has a thin support, a pair of rear webs under the support extending forwardly on either side of the nozzle, the second casing part having a bottom wall and a pair of front webs under the bottom wall extending rearwardly, the pivot means comprising a pivot pin on the rear of each front web and a pivot hole receiving a pivot pin on the front of each rear web.

7. A paper towel dispenser as claimed in claim 1 wherein the nozzle has a tapered outlet opening through it through which the paper towelling is dispensed, and a seat formed in the lower end of the opening for receiving a dispensing ring, the ring having a dispensing opening aligned with the outlet opening, the ring being replaceable.

8. A paper towel dispenser of the type dispensing toweling spirally from the center of a coreless roll of toweling while the roll stands upright, the dispenser having a first casing part, a second casing part and a base; the first casing part having a side wall and a top wall; the second casing part having a side wall, a top wall and a bottom wall; the base having a dispensing nozzle for the toweling; the base detachably attached to the side wall of the first casing part near its bottom; cooperating pivot means on the bottom wall of the second casing part and the underside of the base for detachably, pivotably, connecting the second casing part to the base; the second casing part movable between a first closed position where it forms with the first casing part and the base, an enclosure for a roll of paper toweling that sits on one end on the base; and a second open position where it is pivoted away from the first casing part about the pivot means allowing a new roll of toweling to be mounted on the base.

9. A paper towel dispenser as claimed in claim 8 wherein the base has a support, a pair of rear webs under the support extending forwardly on either side of the nozzle, the second casing part having a bottom wall and a pair of front webs under the bottom wall extending rearwardly, the pivot means comprising a pivot pin on the rear of each front web and a pivot hole receiving a pivot pin on the front of each rear web.

10. A paper towel dispenser as claimed in claim 8 wherein the nozzle has a tapered opening through it through which the paper towelling is dispensed, and a seat formed in the lower end of the opening for receiving a dispensing ring, the ring having a dispensing opening aligned with the tapered opening, the ring being replaceable.

11. A paper towel dispenser as claimed in claim 8, wherein an access opening is provided in the wall of the nozzle, the access opening being normally closed when the second casing part is in the first closed position and being normally open when the second casing part is in the second open position to provide access to the interior of the nozzle to make it easier to thread the toweling through the nozzle when a new roll of toweling is mounted in the dispenser.

12. A paper towel dispenser as claimed in claim 11, wherein the access opening is closed by a wall portion that fits snugly within the opening, the wall portion carried by the second casing part in a position to fit snugly within the access opening when the second casing part is in the first closed position.

13. A paper towel dispenser as claimed in claim 8 including mounting means for mounting the base onto the first casing means and locking means for locking the base in position on the first casing means.

14. A paper towel dispenser as claimed in claim 13 wherein the mounting means comprises a channel formed on the inner surface of the side wall of the first casing part adjacent its bottom edge, the base having a thin support, a portion of the edge of which fits snugly within the channel.

15. A paper towel dispenser as claimed in claim 14 wherein the locking means comprises flexible tabs on the edge of the support, and cutouts on the outer surface of the first casing part, the tabs fitting in the cutouts to lock the base to the first casing part.

16. A paper towel dispenser of the type dispensing towelling spirally from the center of a coreless roll of towelling while the roll stands upright, the dispenser having: a casing; a base; the base having a dispensing nozzle in the approximate center of the base through which towelling from a roll standing on one end on the base is dispensed; means mounting the casing on the base to enclose the roll on the base; the nozzle having a side wall defining a through, tapered, dispensing opening; and an access opening in the side wall to provide access to the tapered opening to help in threading the towelling through the tapered opening when loading a new roll of towelling in the dispenser; and means for normally closing the access opening during dispensing of the towelling.

17. A paper towel dispenser as claimed in claim 16 wherein the access opening extends about one third of the way around the circumference of the nozzle and nearly down to the bottom end of the nozzle leaving a narrow ring at the mouth of the nozzle.

18. A paper towel dispenser as claimed in claim 17 wherein the means closing the access opening comprises a wall section that fits in the access opening, the wall section carried by the casing.

19. A paper towel dispenser of the type dispensing toweling spirally from the center of a coreless roll of toweling while the roll stands upright, the dispenser having casing; a base; the base having a dispensing nozzle in the approximate center of the base through which toweling from a roll standing on one end of the base is dispensed; means mounting the casing on the base to enclose the roll on the base; the nozzle having a side wall defining a through tapered dispensing opening; the dispensing opening having a first cylindrical bore at its lower end and a counterbore above the first bore to form a seat in the side wall within the opening, adjacent the outlet end of the nozzle; and a dispensing ring having a cylindrical base sized to fit on the seat and a cylindrical portion sized to fit in the first bore; the toweling dispensed through the ring; the ring being replaceable when worn or when a different size of a ring is needed.

20. A paper towel dispenser of the type dispensing toweling spirally from the center of a coreless roll of toweling while the roll stands upright, the dispenser having first casing part, a second casing part and a base; the base having a dispensing nozzle for the toweling; the base attached to the bottom of the first casing part; cooperating pivot means on the second casing part and the base for pivotably connecting the second casing part to the base; the second casing part movable between a first closed position where it forms with the first casing part and the base, an enclosure for a roll of paper toweling that sits on one end on the base; and a second open position where it is pivoted away from the first casing part allowing a new roll of toweling to be mounted on the base; the base having a support, a pair of rear webs under the support extending forwardly on either side of the nozzle, the second casing part having a bottom wall and a pair of front webs under the bottom wall extending rearwardly, the pivot means comprising a pivot pin on the rear of each front web and a pivot hole receiving a pivot pin on the front of each rear web.

* * * * *